United States Patent [19]

Chopko et al.

[11] 4,191,198

[45] Mar. 4, 1980

[54] CIGAR HEAD WRAPPING MECHANISM

[75] Inventors: Michael E. Chopko; Hans C. Dreher, both of Dallas, Pa.

[73] Assignee: Culbro Corporation, New York, N.Y.

[21] Appl. No.: 802,668

[22] Filed: Jun. 2, 1977

[51] Int. Cl.[2] ..... A24C 1/30; A24C 1/32

[52] U.S. Cl. ..... 131/76; 131/88

[58] Field of Search ..... 131/88-94, 131/67-69, 58-61 R, 47-51, 32-36, 20 R, 20 A, 21 R, 21 C, 23 R, 26, 27 R, 27 A, 29, 55, 76, 57

[56] References Cited

U.S. PATENT DOCUMENTS 3,064,658 11/1962 Verbakel ..... 131/27

FOREIGN PATENT DOCUMENTS 679253 7/1939 Fed. Rep. of Germany ..... 131/89

94813 7/1939 Switzerland ..... 131/89

*Primary Examiner*—Vincent Millin

*Attorney, Agent, or Firm*—Paul W. Garbo

[57] ABSTRACT

When wrappers are applied to cigar bunches by rolling the bunches over the wrappers while laid on a supporting surface, the tail portion of each wrapper will not properly wrap itself around a shaped head of the bunch. A mechanism to overcome this problem involves a specially designed header block which presses the initial part of the wrapper tail against the shaped head of the rolling bunch, retracts from this pressing operation while the final part or extremity of the tail is being lifted from the supporting surface by the rolling bunch and then presses the lifted extremity of the wrapper tail against the shaped head of the rolling bunch.

15 Claims, 3 Drawing Figures

CIGAR HEAD WRAPPING MECHANISM

BACKGROUND OF THE INVENTION

This invention relates to a mechanism for wrapping the tail of a wrapper strip around the head end of a cigar bunch. More particularly, such mechanism is adapted to apply a flag-shaped tail to a shaped head of a cigar bunch which is rolled over the wrapper strip while laid on a supporting surface.

While several forms of apparatus have been proposed for rolling wrappers on cigar bunches, for many years the most commonly used apparatus in the commercial production of cigars has been the type in which the bunch is cradled between two horizontally spaced rollers and one or more rollers contact the upper side of the bunch. One or more of the rollers are driven so that the bunch in contact therewith rotates about its axis and while the bunch is rotating a wrapper strip is helically wound around the bunch. Such conventional apparatus has the disadvantage that wrapper strips cannot be applied to cigar bunches at rates substantially greater than about 20 per minute.

U.S. Pat. No. 4,010,763 to Hans C. Dreher discloses and claims a completely different type of apparatus for applying wrapper strips to cigar bunches at far greater rates than is possible with conventional apparatus. However, the apparatus of the Dreher invention cannot make flag-shaped tails of wrapper strips contact the heads of cigar bunches when such heads are tapered or rounded. As mentioned in the Dreher patent, flag-shaped tails of wrapper strips must be brought into smooth contact with the shaped heads of bunches either by hand or by a specially developed mechanism.

Accordingly, the principal object of this invention is to provide a mechanism for applying flag-shaped tails of wrapper strips to shaped heads of cigar bunches which are rolled over the wrapper strips while laid on a supporting surface.

Another object is to provide such mechanism with specially designed header blocks which follow the rolling cigar bunches and contact the shaped heads during two separate intervals while the bunches are being rolled.

Still another object is to provide such mechanism wherein the path of the moving header blocks relative to the surface on which the bunches are rolled can be varied to accommodate bunches of different sizes.

These and other objects and advantages of the invention will be apparent from the description which follows.

SUMMARY OF THE INVENTION

In accordance with this invention, a plurality of header blocks are mounted with uniform spacing on endless belts or chains which are disposed over and travel along a supporting surface on which cigar bunches are rolled to helically wind thereon wrapper strips previously laid on the supporting surface. Each bunch is rolled by moving the supporting surface while the bunch is in diametrically opposite contact with a fixed surface parallel to the supporting surface. While such supporting surface may be flat as provided by the upper run of a moving endless belt, the preferred supporting surface is arcuate as provided by the rotating cylindrical drum disclosed in the aforesaid Dreher patent.

The movement of the header blocks is synchronized with the movement of the supporting surface so that one header block will follow closely a rolling cigar bunch, contacting the shaped head thereof while the initial part of wrapper tail is being wound around the head, retracting from contact with the head while the extremity of the tail is being lifted from the supporting surface by the rolling bunch and again contacting the head to press down and smooth out the extremity of the wrapper tail that has become coiled around that head.

The inner concave face of each header block is contoured in relation to the diameter of the cigar bunches and the shape of the heads thereof to which the wrapper is applied with the aid of the mechanism of this invention. Each header block is readily replaceable by another header block appropriately contoured for cigar bunches of a different diameter and head shape. The path of the header blocks on an endless chain can be moved relative to the supporting surface to permit the rolling of cigar bunches of any desired length and diameter.

For a fuller understanding of the invention, the further description thereof will refer to the accompanying drawings of a preferred embodiment adapted to operate in conjunction with the rotating cylindrical drum of the Dreher patent on which cigar bunches are rolled to apply the wrapper thereto.

DESCRIPTION OF A PREFERRED EMBODIMENT

Figure 1:
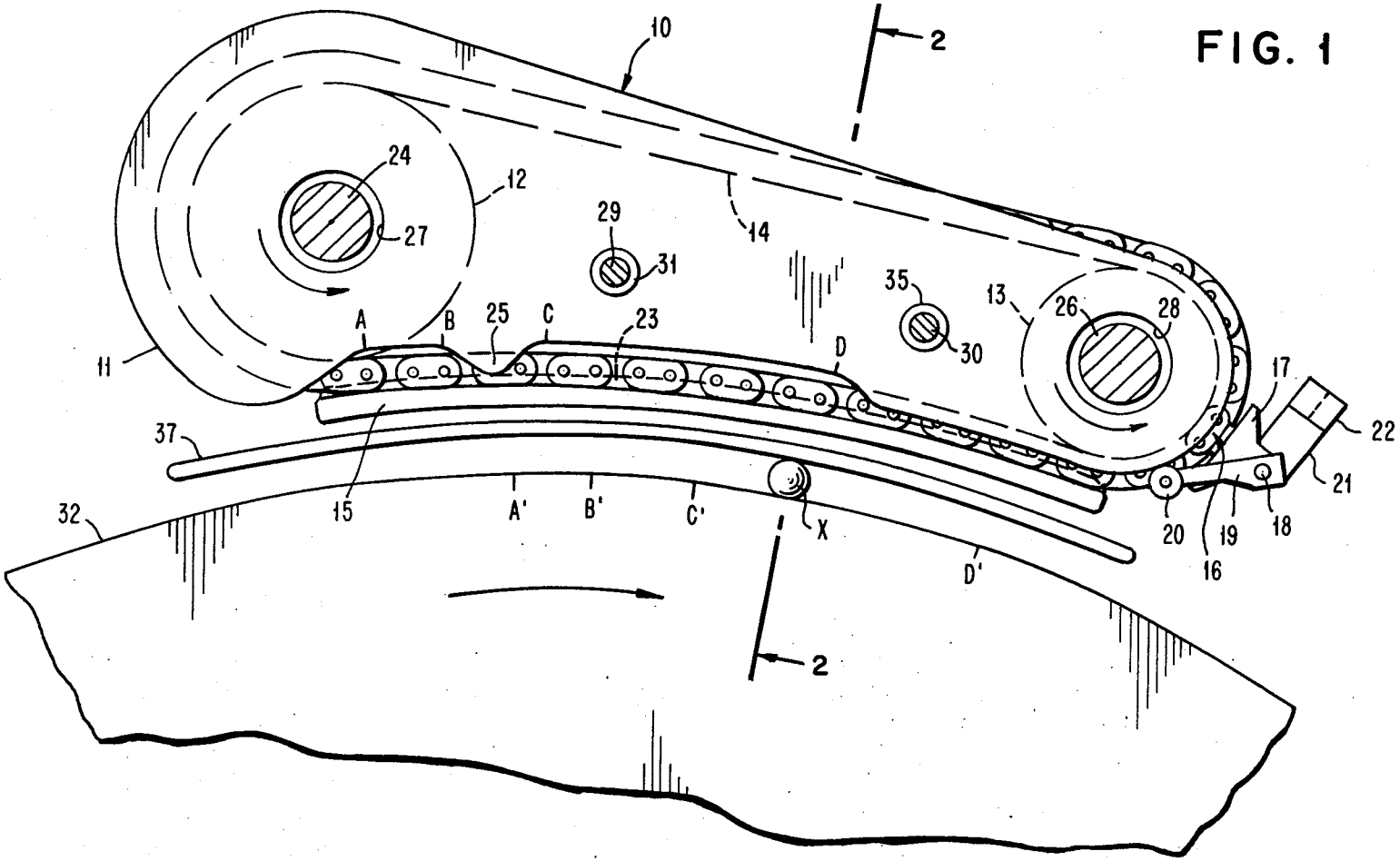
FIG. 1 is a schematic side view of the mechanism of the invention disposed above the portion of a cylindrical drum over which cigar bunches are rolled to apply the wrapper thereto.
Figure 2:
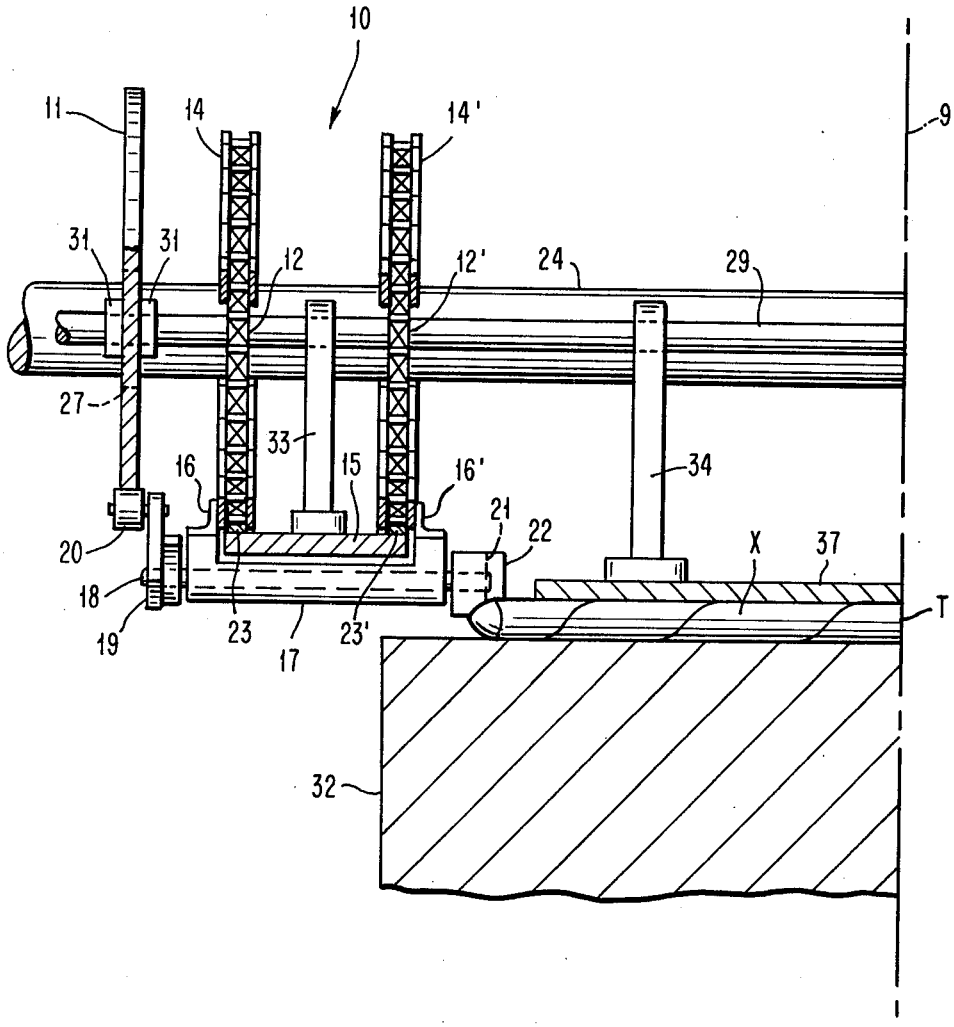
FIG. 2 is a sectional view taken along line 2—2 of FIG. 1, showing only half of the width of the mechanism of FIG. 1 inasmuch as the other half of that width is a mirror image of the half shown in FIG. 2.

FIG. 1 schematically represents a side view of several basic components of mechanism 10 of the invention shown in relation to a peripheral portion of rotating cylindrical drum 32 in FIG. 2 of U.S. Pat. No. 4,010,763 as well as arcuate plate 37 of that patent.

Mechanism 10 comprises cam plate 11 behind which are sprocket wheels 12, 13 carrying endless roller chain 14. The lower run of roller chain 14 rides over arcuate plate 15 so that this portion of chain 14 is maintained parallel to the cylindrical surface of drum 32 during the time that cigar bunch X is being rolled between arcuate plate 37 and drum 32 by the rotation of drum 32. Endless roller chain 14 has a plurality of brackets 16 (only one shown) mounted on chain 14, equally spaced from one another along the entire loop of chain 14. Each bracket 16 has bearing block 17 with shaft 18 therein. Arm 19 with cam roller 20 is attached to the end of shaft 18 nearest to cam plate 11. Arm 21 with header block 22 is attached to the opposite end of shaft 18.

FIG. 2 shows one bracket 16 attached to the lower run of endless roller chain 14 intermediate points C and D of cam plate 11 in FIG. 1 even though this bracket 16 at that position was not shown in FIG. 1 to avoid obscuration of the other components of the mechanism of this invention. To ensure positive tracking of the lower run of chain 14 along arcuate plate 15 rail 23 is so positioned and fastened to the upper side of plate 15 that the rollers of chain 14 ride on rail 23. To prevent any tilting of shaft 18 which is kept parallel to the shaft (not shown) of drum 32, a second sprocket wheel 12' is mounted on the same shaft 24 on which identical wheel 12 is also mounted. Endless roller chain 14' passes around wheel 12' and its lower run rides over rail 23'. Bracket 16' attached to chain 14' holds the end of bearing block 17 opposite to the end held by bracket 16. Thus, the two spaced sprocket wheels 12, 12' with chains 14, 14', rails 23, 23', arcuate plate 15 and brackets 16, 16' support bearing block 17 with shaft 18 in parallel with the axis of cigar bunch X. A single wide sprocket wheel 12 with a wide chain 14 may in some embodiments of the invention suffice but it is generally preferred to use two spaced sprocket wheels 12, 12' for greater stability of traveling shaft 18 and its associated components.

FIG. 2 is the schematic representation of only half of the axial length of Dreher's drum 32 and the mechanism of this invention because the other half beyond the center line 9 is merely a mirror image of FIG. 2. While the preferred embodiment of the invention being described is adapted to apply wrapper to both shaped heads of double cigar bunches, the invention can also be used to apply wrapper to the shaped head of single length cigar bunches. For the latter embodiment, FIG. 2 would be the schematic representation of the entire mechanism of this invention; only drum 32 would desirably have its axial length increased so that the tuck end T of single length cigar bunch X would not be at the edge of drum 32. Incidentally, for such single length cigar bunches, the other parts of the Dreher apparatus in U.S. Pat. No. 4,010,763 would also be half of the axial length shown for his drums 22, 26 and shaft 30 so that wrapper sheet S of half width would be cut into parallelogram strips corresponding to one side or half of the V-shaped segment shown in FIG. 1 of the Dreher patent.

Referring to FIG. 1 hereof, the lower edge of cam plate 11 is marked at four points with the letters A, B, C, D and four points on the cylindrical surface of drum 32 are marked with the letters A', B', C', D'. When cam roller 20 of each traveling bracket 16 reaches point A of plate 11, header block 22 of that bracket 16 is pivotally pressed down so that it contacts the shaped head of cigar bunch X as shown in FIG. 2; such contact starts when bunch X is at point A' on drum 32. Block 22 remains in contact with the shaped head of bunch X while roller 20 is moving along the bottom edge of plate 11 from point A to point B and simultaneously bunch X is rolling over the surface of drum 32 between points A' and B'. When roller 20 starts at point B to move over bump 25 of cam plate 11, block 22 begins at point B' on drum 32 to withdraw from contact with the shaped head of bunch X. At the peak of bump 25, roller 20 causes the maximum retraction of block 22 away from the shaped head of bunch X; in moving from the peak of bump 25 to point C, roller 20 pivotally causes block 22 to move toward the shaped head of bunch X so that when roller 20 reaches point C block 22 will again be in full contact with the head of bunch X at corresponding point C' on drum 32. As roller 20 travels along the edge of plate 11 from point C to point D, block 22 remains in contact with the head of bunch X while bunch X is being rolled over the surface of drum 32 between points C' and D'. At point D' the application of the wrapper to bunch X has been completed and the fully wrapped bunch X is about to be discharged from under plate 37. Simultaneously, roller 20 starts at point D to move along the sloping edge portion of plate 11 causing block 22 to withdraw from contact with the head of bunch X so that fully wrapped bunch X can be discharged from under plate 37 without obstruction from header block 22. To summarize, block 22 is in pressing contact with the shaped head of bunch X only while bunch X is being rolled between points A' and B' and again between C' and D' of drum 32.

The reason that block 22 is lifted away from the head of bunch X while it is rolling between points B' and C' of drum 32 is that the flag-shaped end of the wrapper strip leaves the surface of drum 32 and flips around the head of bunch X during the rolling of bunch X between points B' and C'. If block 22 were still pressing against the head of bunch X while the flag-shaped end of the wrapper strip is being flipped around the head, block 22 would fold back that flag-shaped end and thus prevent the proper wrapping of the flag-shaped end around the head of bunch X. Once the flag-shaped end of the wrapper strip has been flipped around the head of bunch X, block 22 again comes down into contact with the head of bunch X to press down and smooth out the wrapper around the head while bunch X is being rolled between points C' and D' of drum 32. For better visualization, FIG. 2 shows the wrapper strip completely wound helically around cigar bunch X which is the appearance attained only when bunch X has really reached point D' on drum 32; at line 2—2 of FIG. 1 the flag-shaped end of the wrapper strip has not yet been completely coiled and pressed around the shaped head of bunch X.

Figure 3:
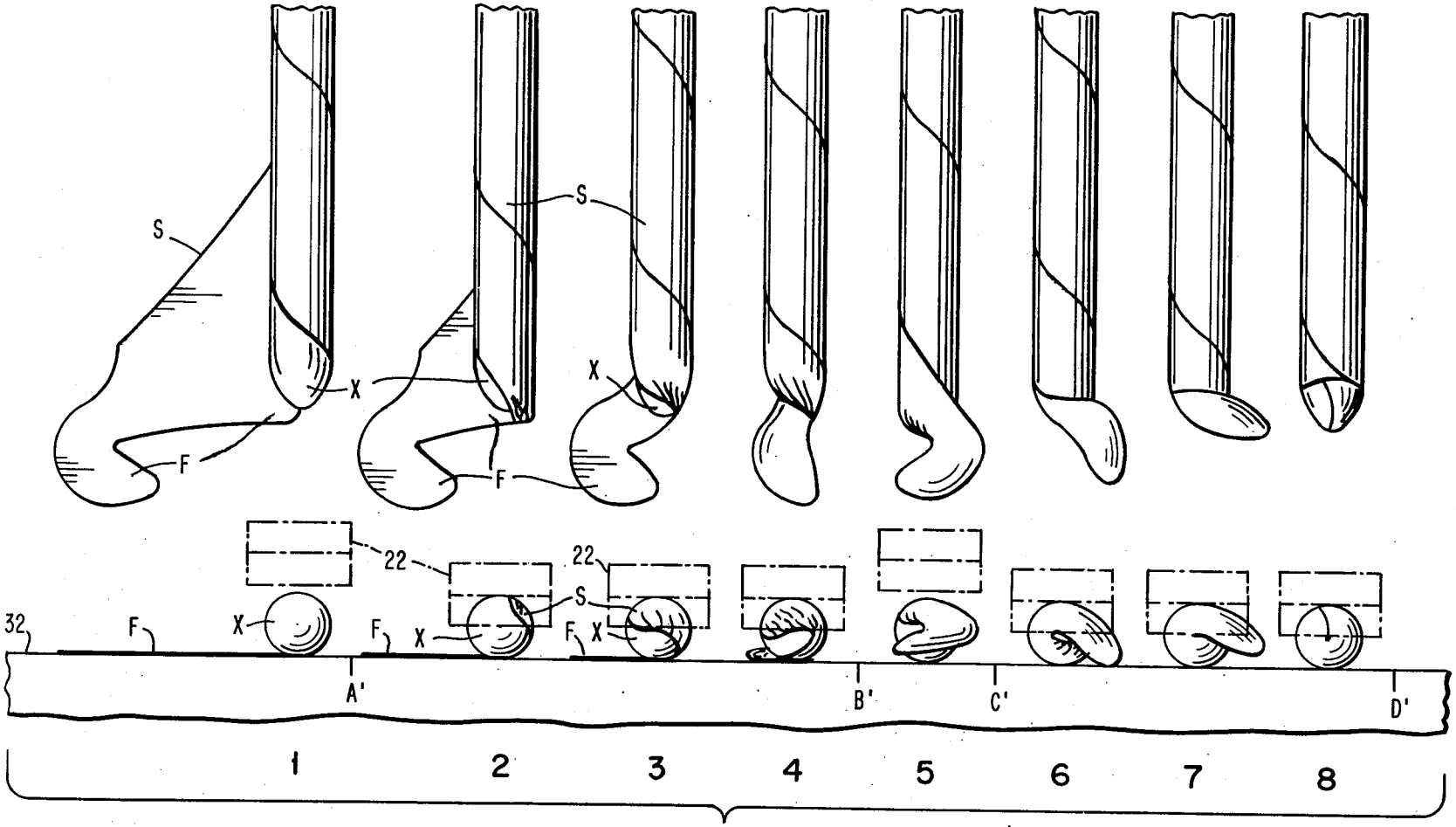
FIG. 3 is a diagrammatic representation of eight progressive stages in the rolling of a cigar bunch during which the wrapper is applied to the shaped head of the bunch with the aid of the mechanism of FIGS. 1 and 2.

For further clarification of the need to interrupt the contact of header block 22 with the shaped head of bunch X after such contact starts at point A' on drum 32, FIG. 3 presents diagrammatically eight stages in the final rolling of bunch X in wrapper strip S. The upper portion of FIG. 3 is a plan view of only bunch X and strip S at each of the eight stages while the lower portion of FIG. 3 is an end elevation at each stage together with header block 22 shown with phantom lines so as not to obscure the wrapping of the shaped head of bunch X.

Stage 1 of FIG. 3 shows bunch X before it reaches point A' of drum 32 and before cam roller 20 reaches point A of plate 11 in FIG. 1. It is evident in FIG. 3 that the flag-shaped end, more simply called flag F, of wrapper strip S extends beyond the length of bunch X. At stage 1, entire flag F is still on the surface of drum 32 (shown flat for convenience of representation) and header block 22 is in a raised position out of contact with the shaped head of bunch X. Stage 2 shows that a small portion of flag F has been partially rolled around the shaped head of bunch X while block 22 has come down to press that portion of flag F against the head of bunch X. Stage 2 is a representation of bunch X just after it has rolled past point A' on drum 32. Stage 4 shows bunch X just before it reaches point B' on drum 32 and stage 3 shows bunch X midway between points A' and B'. From stage 2 through stage 4, block 22 is down and is guiding and creasing flag F around the head of bunch X. In stage 4, the tip of flag F is still on the surface of drum 32.

Stage 5 shows bunch X after it has rolled past point B' of drum 32 and block 22 has been lifted away from contact with the head of bunch X by the movement of roller 20 over bump 25 of cam plate 11 in FIG. 1. The plan view of stage 5 shows that the tip of flag F has not only been completely removed from the surface of drum 32 but has even been flipped up so that it now lies over the shaped head of bunch X rather than under the head as it was during the prior stages of the rolling operation.

Stage 6 presents bunch X just after it has rolled past point C' on drum 32 and stage 8 shows bunch X just before it has reached point D'. Stage 7 presents bunch X at an intermediate position between points C' and D' on drum 32. During stages 6, 7 and 8, header block 22 is down in contact with the shaped head of bunch X to guide and smooth out the tip of flag F around that head. Thus, the smoothed tip of flag F forms a cap over the underlying creased portions of flag F on the shaped head of bunch X. At point D' of drum 32, the rolling of flag F around the shaped head of bunch X has been completed and block 22 will start to move away from the head as bunch X continues to roll toward the discharge end of arcuate plate 37 in FIG. 1.

Shaft 24 with sprocket wheels 12, 12' mounted thereon and shaft 26 with sprocket wheels 13, 13' mounted thereon extend through openings 27 and 28, respectively, in cam plate 11 without making contact with plate 11. The free end of shaft 24 or 26 is connected through a gear train and timing belt (not shown) to the driven shaft of drum 32 so that mechanism 10 of the invention will be driven in timed relation to the rotation of drum 32. Alternatively, the free end of shaft 24 or 26 may be connected to an electric motor adapted to drive mechanism 10 in timed relation to the rotation of drum 32. The free end of the other shaft 26 or 24 is rotably mounted in a fixed bearing block (not shown). It is advisable to have the opposite free ends of shafts 24 and 26 extend through openings in the cam plate of the mirror image of FIG. 2 and to support these free ends in fixed bearing blocks.

A pair of horizontal rods 29, 30 with the ends of each suitably held in fixed supports (not shown) are positioned between the top and bottom runs of roller chains 14, 14' and between shafts 24, 26 and pass through cam plate 11. Rods 29, 30 are parallel to shafts 24, 26. A pair of ring clamps 31 on support rod 29 and on opposite sides of plate 11 hold plate 11 in the desired position. Brackets 33 and 34 (shown only in FIG. 2) mounted on rod 29 extend to arcuate plates 15 and 37, respectively, to hold these plates in the desired positions. A pair of ring clamps 35 (shown in FIG. 1) on rod 30 and on opposite sides of plate 11 hold plate 11 in a fixed position. Brackets similar to brackets 33 and 34 connect plates 15 and 37 to support rod 30.

Cigar bunch X rolling between rotating drum 32 and stationary arcuate plate 37 has a translational speed which is half of the peripheral speed of drum 32. Accordingly, mechanism 10 must be driven so that each header block 22 moving parallel to the cylindrical surface of drum 32 will keep pace with a bunch X. Therefore, roller chains 14, 14' move each block 22 over the cylindrical surface of drum 32 with a peripheral speed which is substantially half of that of drum 32. To maintain this timed relation between rotating drum 32 and moving chains 14, 14', a gear train and timing belt assembly interconnecting the shaft of drum 32 and shaft 24 or 26 of mechanism 10 is preferred over two independent electric motors connected to drum 32 and mechanism 10 because with such mechanical interconnection the rotational speed of drum 32 can be increased or decreased as desired and automatically the movement of each bracket 16 along the surface of drum 32 will be commensurately increased or decreased so that at all speeds of drum 32 a header block 22 will keep pace with a cigar bunch X rolling under arcuate plate 37.

It is well to note that header block 22 of this invention can for most shaped heads of cigar bunches have a contoured but longitudinally straight surface for contacting the shaped head which contoured surface has a profile matching half of the profile of that head extending from the cylindrical surface of the cigar bunch to the axis of that bunch (see block 22 in FIG. 2).

As already mentioned, each cigar bunch X rolling between stationary arcuate plate 37 and rotating drum 32 will advance under plate 37 from the entry end to the discharge end of plate 37 at one-half of the peripheral speed of drum 32. This means that the point on the surface of drum 32 on which cigar bunch X was resting at the instant when cigar bunch X entered the entry end of plate 37 will reach the discharge end of plate 37 while bunch X will only be midway between the entry and discharge ends of plate 37. Inasmuch as efficient design of Dreher's drum 32 dictates that the V-shaped wrapper segments should be deposited on the cylindrical surface of drum 32 with only a small clearance between the point thereof where the two tails of one V-shaped segment end and the apex of the next successive V-shaped segment, it follows that another cigar bunch X will enter the entry end of plate 37 while the preceding bunch X is midway between the opposite ends of plate 37. Hence, with such design there are always two bunches X being rolled between plate 37 and rotating drum 32. Of course, such close spacing of bunches X is not a necessity.

An illustrative example of mechanism 10 of this invention used in conjunction with drum 32 of the exemplary embodiment of the invention in U.S. Pat. No. 4,010,763 to Dreher has five header blocks 22 attached to roller chains 14, 14', equally spaced from one another over the full loop length of chains 14, 14'. Drive shaft 24 of mechanism 10 is driven through a suitable gear train and timing belt by the shaft of drum 32 so that each header block 22 keeps pace with a bunch X rolling on the cylindrical surface of drum 32. Since the cylindrical surface of exemplary drum 32 of the Dreher patent has ten equally spaced grooves or positions for carrying a double cigar bunch to plate 37, each header block 22 travels the full loop length of chains 14, 14' twice for each complete rotation of drum 32. Thus, each header block 22 will serve to wrap the flag-shaped end of a wrapper strip around the shaped head of a cigar bunch X brought to arcuate plate 37 by each of two diametrically opposite grooves on drums 32. When drum 32 having a diameter of 105.10 centimeters is rotating at a speed of 25 revolutions per minute to wrap 250 double cigar bunches in V-shaped wrapper segments per minute, the peripheral speed of drum 32 is 82.55 meters per minute. Simultaneously, roller chains 14, 14' moving over arcuate plate 15 carry each block 22 adjacent the surface of drum 32 at a speed of 41.275 meters per minute.

The mechanism of the invention is adjustable so that it can operate on cigar bunches of different sizes. Thus, for longer bunches than the one shown in FIG. 2, cam plate 11 with its two ring clamps 31 and bracket 33 are moved to the left on rod 29 and sprocket wheels 12, 12' are also moved to the left on shaft 24. Simultaneously, the same adjustments are made on rod 30 and shaft 26. For cigar bunches of smaller diameter than the one shown in FIG. 2, arcuate plate 37 is brought closer to the cylindrical surface of drum 32 by adjusting bracket 34 on rod 29 and the similar bracket on rod 30. Header blocks 22 are changed to accommodate the heads of cigar bunches of different diameters as well as different head contours. Furthermore, bump 25 on the lower edge of cam plate 11 can be a separate piece screwed to plate 11 so that its position in FIG. 1 can be moved a little to the right or left when required by cigar bunches of a different diameter.

To simplify the explanation of the mechanism of the invention, hereinbefore mention was made of points A', B', C', D' of or on drum 32 as shown in FIG. 1. Actually, these points A', B', C', D' are fixed in space and do not move with the rotation of drum 32. Hence, points A', B', C', D' really indicate positions of bunch X reached at different stages of its rolling on the cylindrical surface of drum 32.

As pointed out in U.S. Pat. No. 4,010,763, it is known that fixed arcuate plate 37 may be replaced by an endless flexible belt movable clockwise with the clockwise rotation of drum 32 shown in FIG. 1 hereof to speed up the rolling of bunch X or such endless belt may be driven counterclockwise to slow down the rolling of bunch X on the cylindrical surface of drum 32 rotating clockwise.

Various modifications of the invention will be apparent from the foregoing disclosure. Accordingly, only such limitations should be imposed on the scope of the invention as are set forth in the appended claims.

What is claimed is:

1. An apparatus adapted to wrap a wrapper strip around a cigar bunch with a shaped head by rolling said bunch over said strip while said strip is on a supporting surface, in combination with a mechanism for pressing the tail portion of said strip onto said head during said rolling of said bunch which comprises a conveyor having a portion movable along said supporting surface, and a header block carried by said conveyor into contact with said head while said tail portion is being wrapped around said head, said block having a shaped face to make conforming contact with said head.

2. The mechanism of claim 1 which includes means for temporarily withdrawing the header block from contact with the shaped head of the cigar bunch while the extremity of the tail portion of the wrapper strip is being removed from the supporting surface and is being flipped over by the rolling of said bunch.

3. The mechanism of claim 1 in which the conveyor comprises at least one endless roller chain stretched around two spaced sprocket wheels.

4. The mechanism of claim 3 which includes a fixed cam plate adjacent to the conveyor and a cam roller pivotally associated with the header block, said plate being contoured so that said roller moving in contact therewith causes temporary withdrawal of said block from contact with the shaped head of the cigar bunch while the extremity of the tail portion of the wrapper strip is being removed from the supporting surface and is being flipped over by the rolling of said bunch.

5. The mechanism of claim 4 in which the supporting surface is the cylindrical surface of a rotatable drum and the lower run of the endless roller chain is maintained parallel to said cylindrical surface.

6. The mechanism of claim 5 in which the lower run of the endless roller chain is driven in the direction of rotation of the rotatable drum to move the header block at substantially one-half of the peripheral speed of said drum.

7. An apparatus adapted to wrap a wrapper strip around a cigar bunch with a shaped head by rolling said bunch between an arcuate surface and a rotating drum with said strip laid on its cylindrical surface, in combination with a mechanism for pressing the tail portion of said strip onto said head during said rolling of said bunch which comprises an endless conveyor with its lower run maintained arcuately parallel to said cylindrical surface, a plurality of brackets mounted on said conveyor equally spaced from one another, a header block supported by each of said brackets so that said block will contact said head while its bracket is in said lower run, each said block having a shaped face to make conforming contact with said head, and drive means operative from said drum to said conveyor to drive said lower run in the direction of rotation of said drum.

8. The mechanism of claim 7 which includes means for temporarily withdrawing the header block from contact with the shaped head of the cigar bunch while the extremity of the tail portion of the wrapper strip is being removed from the cylindrical surface and is being flipped over by the rolling of said bunch.

9. The mechanism of claim 8 in which the endless conveyor comprises two endless roller chains, each stretched around two sprocket wheels mounted on two spaced rotatable shafts, said two wheels of one of said chains being axially spaced on said shafts from said two wheels of the other of said chains, and the lower run of each of said chains moves over an arcuate rail disposed parallel to the cylindrical surface of the drum.

10. The mechanism of claim 9 in which each header block is mounted on one end of a small rotatable shaft and a cam roller is pivotally mounted on the other end of said small shaft, a bracket from each of the two roller chains supports a bearing for said small shaft, and a cam plate is disposed adjacent to one of said chains so that each said cam roller rides on the contour of said plate and pivotally withdraws said block associated with said cam roller temporarily from contact with the shaped head of a cigar bunch while the extremity of the tail portion of the wrapper strip is being removed from the cylindrical surface of the drum and is being flipped over by the rolling of said bunch.

11. In an apparatus adapted to wrap a wrapper strip around a cigar bunch with a shaped head by rolling said bunch over said strip while laid helically on the cylindrical surface of a rotating drum, said rolling of said bunch being effected between an arcuate surface and said drum by the rotation of said drum, the improvement of a device for pressing the tail portion of said strip onto said head during said rolling of said bunch which comprises a header block contoured in general conformance with said head, means for maintaining said block in contact with said head during said rolling of said bunch, and means for temporarily interrupting the contact of said block with said head while the extremity of said tail portion of said strip is being removed from said cylindrical surface and is being flipped over by said rolling of said bunch.

12. The device of claim 11 in which the means for maintaining the header block in contact with the shaped head of the cigar bunch comprises a conveyor to which said block is attached, said conveyor being formed of two endless roller chains, each stretched around two sprocket wheels mounted on two spaced rotatable shafts, said two wheels of one of said chains being axially spaced on said shafts from said two wheels of the other of said chains, and drive means for said conveyor to move said block in the direction of rotation of the drum.

13. The device of claim 12 in which the means for temporarily interrupting the contact of the header block with the shaped head of the cigar bunch comprises a fixed cam plate and a cam roller attached to the conveyor and pivotally associated with said block.

14. The device of claim 11 in which all of its component parts are duplicated and arranged adjacent the cylindrical surface of the rotating drum as two mirror-image sets so that the header block of one set contacts one shaped head of a double cigar bunch and the header block of the other set simultaneously contacts the other shaped head of said double bunch.

15. The device of claim 14 in which the duplicate means for maintaining the duplicate header blocks in contact with the two shaped heads of the double cigar bunch comprise duplicate endless conveyors for said duplicate blocks, said duplicate conveyors being stretched around the same two spaced rotatable shafts, and drive means connected to one of said shafts to move said duplicate blocks in the direction of rotation of the drum.

* * * * *